US006836916B2

(12) United States Patent
Chen et al.

(10) Patent No.: US 6,836,916 B2
(45) Date of Patent: Jan. 4, 2005

(54) PROCESS FOR MAKING A WATERPROOF SHOE

(75) Inventors: Eddie Chen, 9F, No. 201, Sec. 1, Taichung-Kang Rd., Taichung City (TW); Melissa Wang, Taichung (TW)

(73) Assignee: Eddie Chen, Taichung (TW)

( * ) Notice: Subject to any disclaimer, the term of this patent is extended or adjusted under 35 U.S.C. 154(b) by 88 days.

(21) Appl. No.: 10/401,465

(22) Filed: Mar. 28, 2003

(65) Prior Publication Data

US 2004/0187352 A1 Sep. 30, 2004

(51) Int. Cl.[7] ..... A43B 9/08; A43B 9/02

(52) U.S. Cl. ..... 12/142 A; 12/142 T; 36/55; 36/19 A

(58) Field of Search ..... 36/55, 17 A, 19 A, 36/14; 12/146 C, 142 T, 142 A

(56) References Cited

U.S. PATENT DOCUMENTS

RE34,890 E * 4/1995 Sacre ..... 36/55
5,421,050 A * 6/1995 Laganas ..... 12/142 T
6,065,227 A * 5/2000 Chen ..... 36/55
6,446,360 B1 * 9/2002 Sheets et al. ..... 36/55
6,474,002 B2 * 11/2002 Chen ..... 36/55
2003/0009908 A1 * 1/2003 Sheets et al. ..... 36/55

* cited by examiner

*Primary Examiner*—Anthony D. Stashick
(74) *Attorney, Agent, or Firm*—Ladas & Parry

(57) ABSTRACT

In a process for making a waterproof shoe, an upper and a waterproof lining unit with open top and bottom ends are prepared. The lining unit is placed within the upper, and the top ends of the upper and the lining unit are interconnected. A cover member is then attached to the bottom end of the upper to close the bottom end of the upper. After an outsole is attached to the bottom end of the upper, the lining unit is pulled out from the upper through the top end of the upper so that the bottom end of the lining unit moves away from the upper. The outsole is then sewn to the bottom end of the upper, thus forming a reinforcing sewing line that interconnects the outsole and the upper. Thereafter, the lining unit is re-inserted into the upper.

14 Claims, 12 Drawing Sheets

PROCESS FOR MAKING A WATERPROOF SHOE

BACKGROUND OF THE INVENTION

1. Field of the Invention

The invention relates to a process for making a waterproof shoe, more particularly to a process for making a waterproof shoe having reinforced connection between an upper and an outsole.

2. Description of the Related Art

Referring to FIG. 1, a conventional waterproof shoe is shown to include an upper 1, a lining unit 2 which includes an inner lining 201, a waterproof lining 202 and an insole 203, and an outsole 3 bonded to a bottom end of the upper 1. Top ends of the inner lining 201 and the waterproof lining 202 are sewn together with a top end of the upper 1. Bottom ends of the inner lining 201 and the waterproof lining 202 are secured to an outer peripheral edge portion of the insole 203. If, for the purpose of strengthening connection between the upper 1 and the outsole 3, reinforcing sewing lines are provided by sewing together the bottom end of the upper 1 and the peripheral edge or bottom side of the outsole 3 through the inner lining 201, the reinforcing sewing lines will extend through the bottom end of the waterproof lining 202 to destroy the waterproof characteristic of the conventional waterproof shoe. Therefore, reinforcing sewing lines are not provided in the conventional waterproof shoe. Nonetheless, manufacturers will often provide a decorative sewing line 4 along the peripheral edge or bottom side of the outsole 3 prior to attachment of the outsole 3 to the upper 1 so that the waterproof shoe appears to have reinforcing sewing lines. However, during the process of sewing the decorative sewing line 4 through the peripheral edge of the outsole 3 by using a sewing machine, oil may penetrate thereinto to affect adversely the bonding of the outsole 3 to the upper 1 so that there may be gaps between the outsole 3 and the upper 1.

SUMMARY OF THE INVENTION

Therefore, the main object of the present invention is to provide a process for making a shoe which is waterproof but is still provided with reinforcing sewing lines interconnecting an upper and an outsole. According to the present invention, a process for making a waterproof shoe comprises:

(a) preparing an upper and a waterproof lining unit, each of which opens at top and bottom ends thereof;

(b) placing the lining unit within the upper, and connecting the top end of the upper to the top end of the lining unit;

(c) attaching a cover member to the bottom end of the upper to close the bottom end of the upper;

(d) inserting a last into the lining unit, and attaching an outsole to the bottom end of the upper;

(e) removing the last from the lining unit;

(f) pulling out the lining unit from the upper through the top end of the upper so that the bottom end of the lining unit moves away from the upper;

(g) sewing the outsole to the bottom end of the upper by using a sewing machine, thus forming a reinforcing sewing line that interconnects the outsole and the upper, wherein a component of the sewing machine is inserted into the upper through the bottom end of the lining unit;

(h) sealing the bottom end of the lining unit after step (g); and (i) re-inserting the lining unit into the upper.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
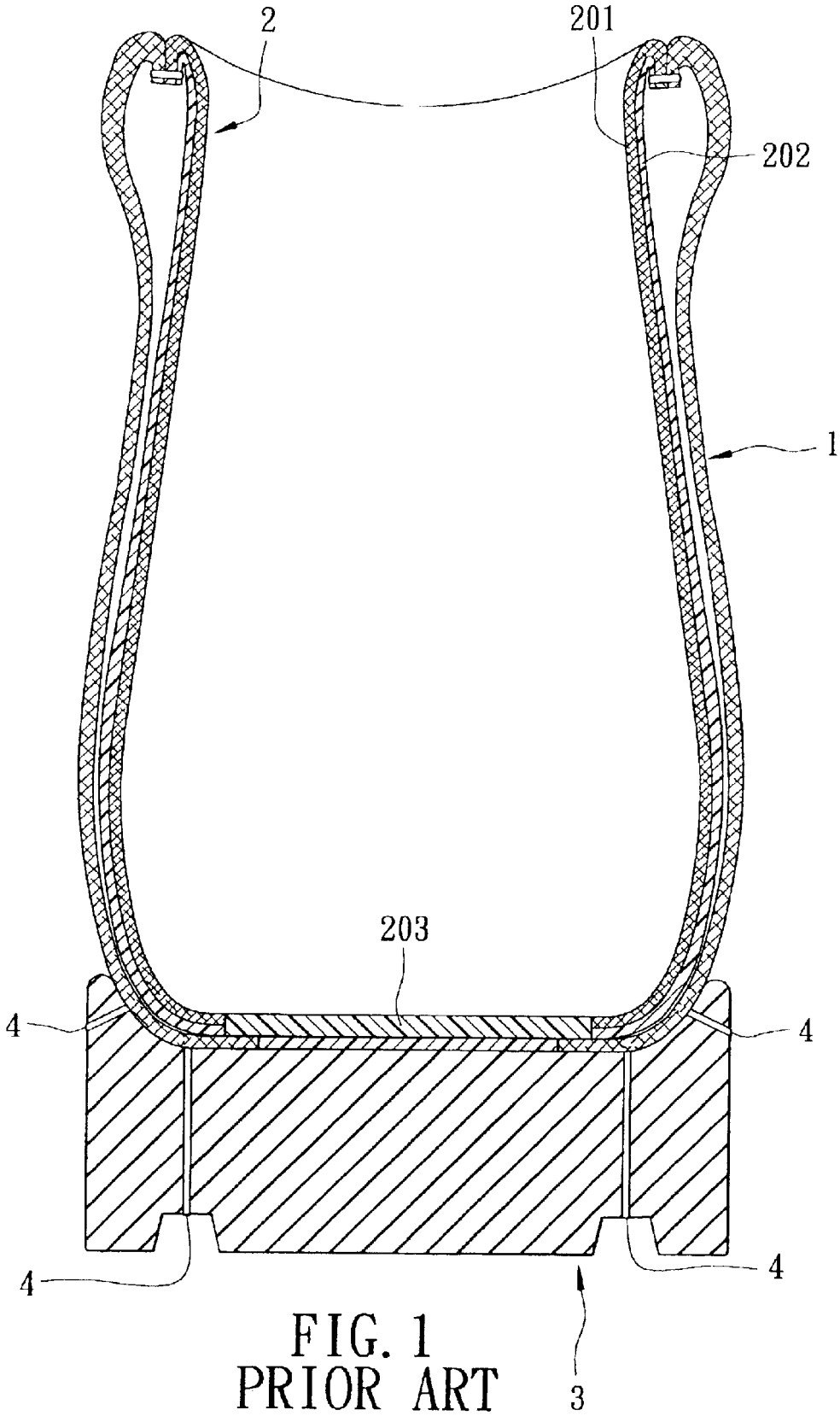
FIG. 1 PRIOR ART
FIG. 1 is a sectional view of a conventional waterproof shoe in an assembled state.

Before the present invention is described in greater detail, it should be noted that like elements are denoted by the same reference numerals throughout the disclosure.

Referring to FIGS. 2 to 5, the first preferred embodiment of a process for making a waterproof shoe according to the present invention is shown to include the step of preparing an upper 10 and a waterproof lining unit 20. The upper 10 has an open top end 11, and an open bottom end 12 opposite to the top end 11. The lining unit 20 has an open top end 21, and an open bottom end 22 opposite to the top end 21 and defining a substantially sole-shaped opening 221 (see FIG. 4). The lining unit 20 is placed within the upper 10, and the top end 11 of the upper 10 is connected to the top end 21 of the lining unit 20 by sewing. In this embodiment, the lining unit 20 is provided by assembling together an inner lining 23 and a waterproof breathable lining 24. The waterproof breathable lining 24 has a top end connected to a top end of the inner lining 23 and the top end 11 of the upper 10 by sewing, and a bottom end disposed adjacent to a bottom end of the inner lining 23. In addition, in order to achieve the intended waterproofing effect of the lining unit 20, the waterproof breathable lining 24 is first adhered to an outer surface of the inner lining 23 so that the waterproof breathable lining 24 is disposed between the upper 10 and the inner lining 23, and is then cut into a desired shape and size. Alternatively, the waterproof breathable lining 24 can be substituted with a waterproof coating layer 26 that is applied to the outer surface of the inner lining 23 to achieve the same waterproofing effect.

Subsequently, a cover member 30 is disposed in an opening 121 confined by the bottom end 12 of the upper 10, and a peripheral edge of the cover member 30 is attached to the bottom end 12 of the upper 10 to close the opening 121. In this embodiment, the cover member 30 is an insole of non-woven fabric.

Figure 2:
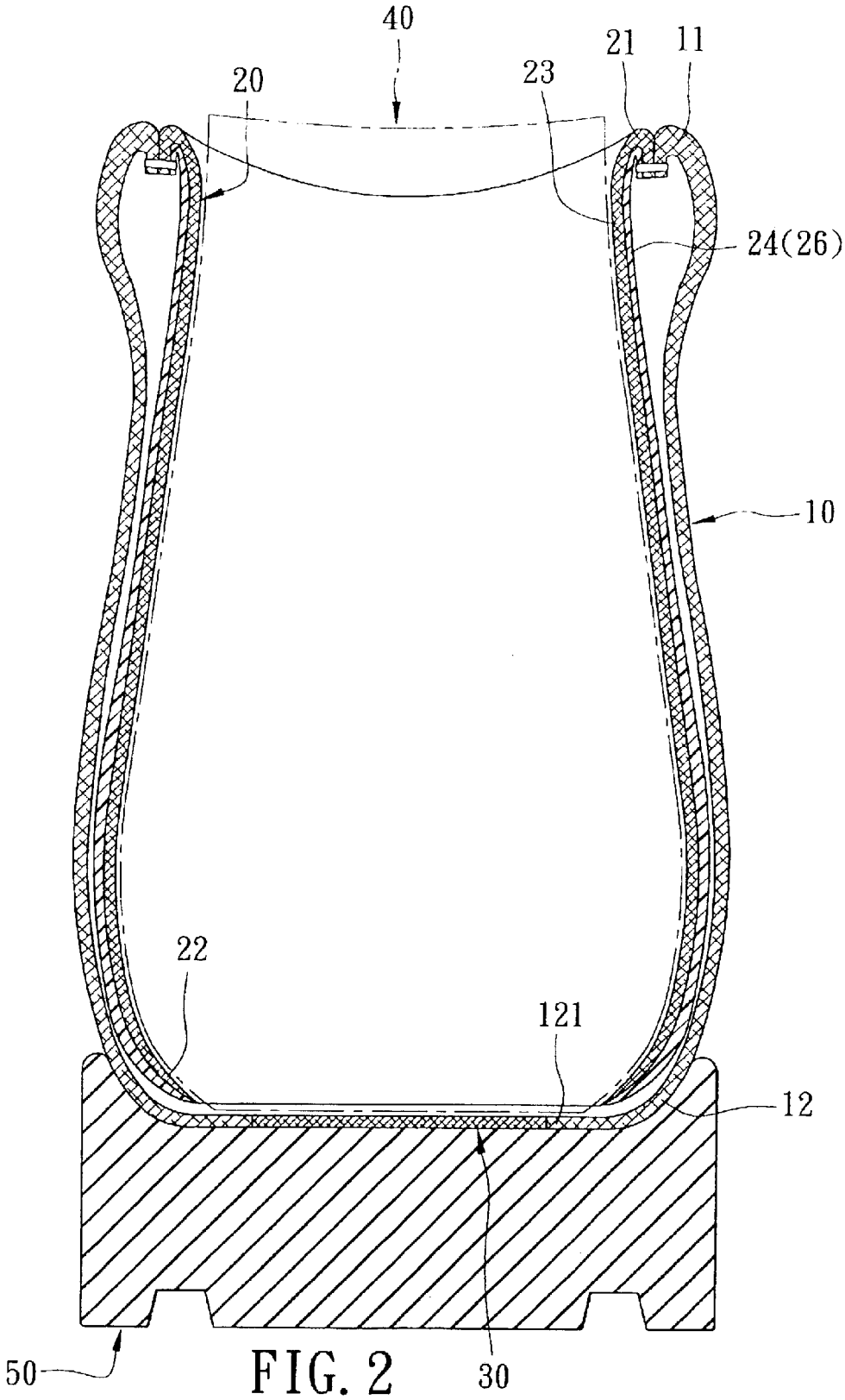
FIG. 2 is a sectional view of a semi-finished waterproof shoe made using the first preferred embodiment of a process according to the present invention.
Figure 3:
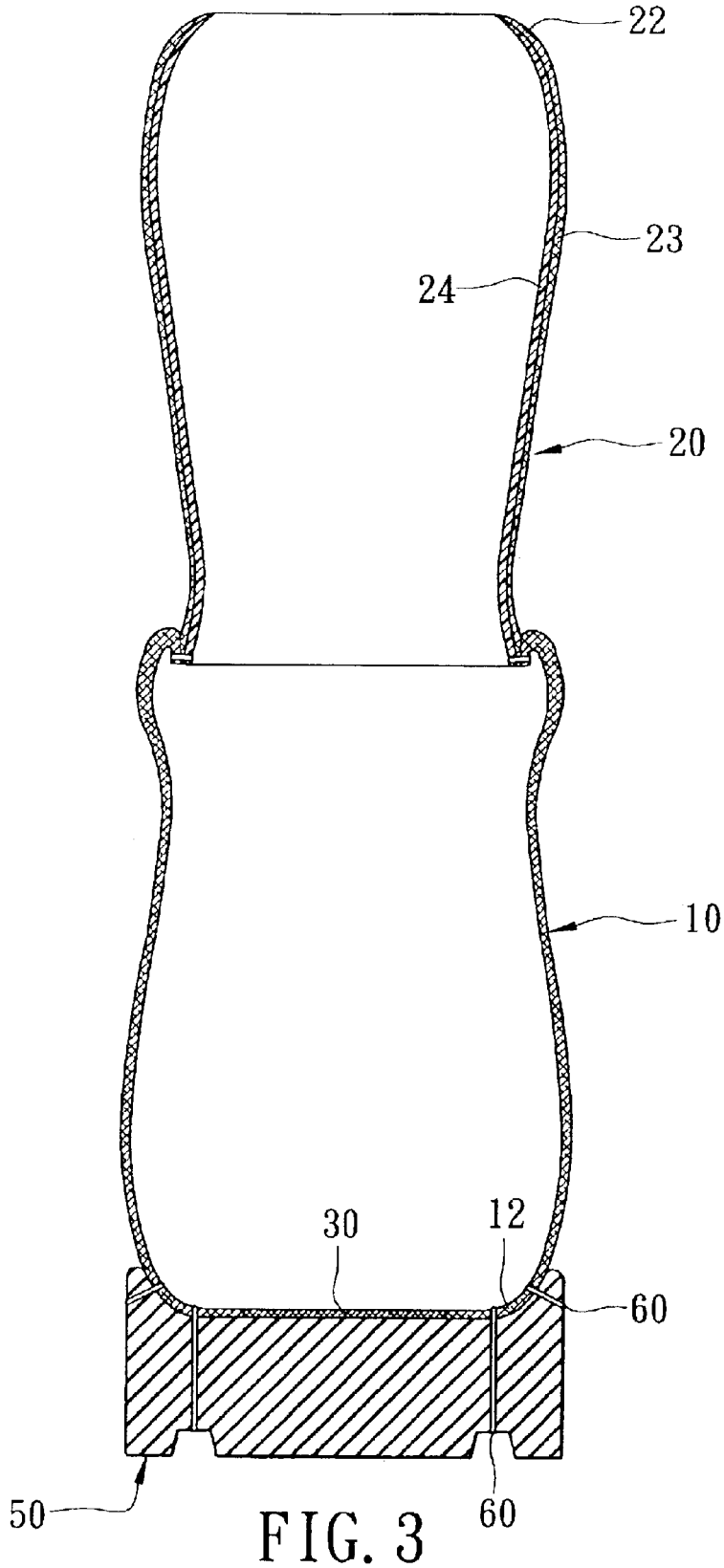
FIG. 3 is a sectional view of the first preferred embodiment, illustrating the step of pulling a bottom end of a lining unit out of an upper.

A last 40 is then inserted through the top end 21 of the lining unit 20 into the inner lining 23, and an outsole 50 is adhered to the bottom end 12 of the upper 10. Referring to FIGS. 2 and 3, the last 40 is removed from the lining unit 20, and the bottom end 22 of the lining unit 20 is pulled out from the upper 10 through the top end 11 of the upper 10 so that the bottom end 22 of the lining unit 20 moves away from the upper 10.

Thereafter, the outsole 50 is sewn to the bottom end 12 of the upper 10 by using a sewing machine (not shown), thus forming reinforcing sewing lines 60 that interconnect the outsole 50 and the upper 10. In this sewing step, a component of the sewing machine is inserted into the upper 10 through the bottom end 22 of the lining unit 20.

Figure 4:
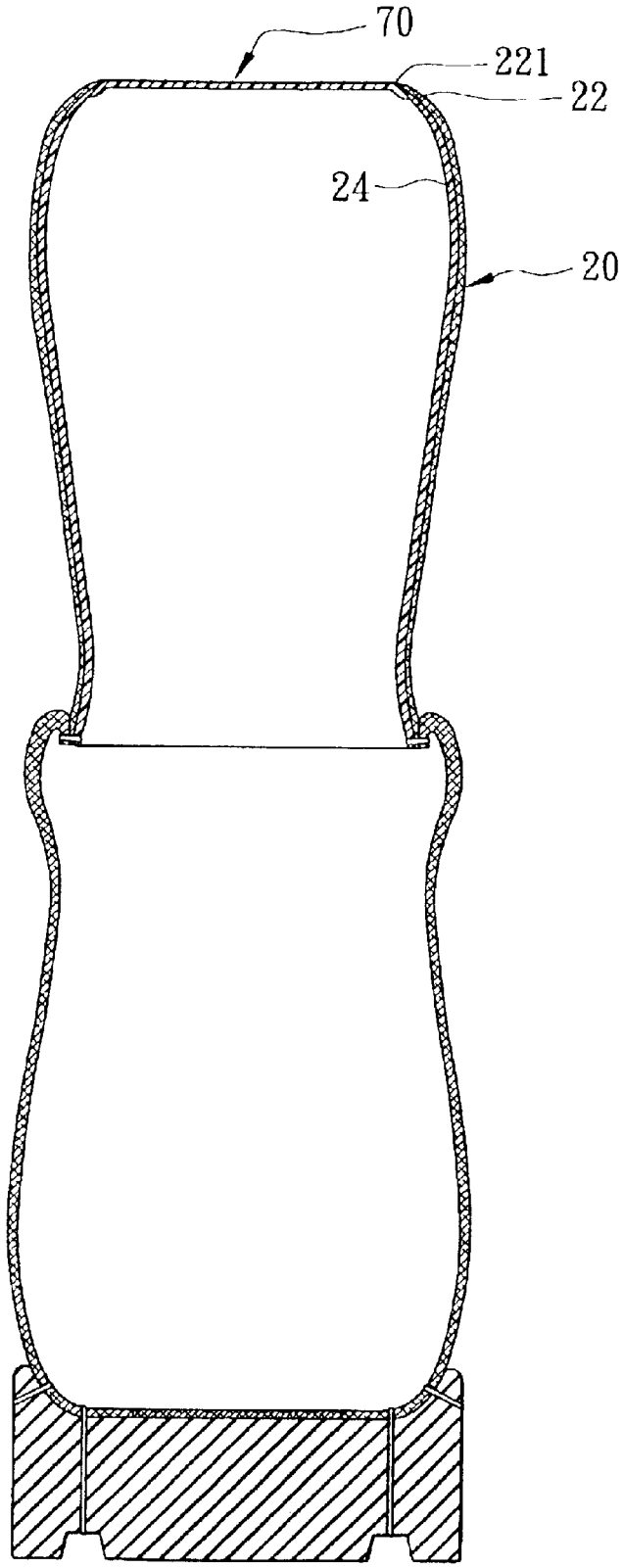
FIG. 4 is a sectional view of the first preferred embodiment, illustrating the step of forming reinforcing sewing lines and the step of attaching a waterproof member to the bottom end of the lining unit.

Subsequently, referring to FIG. 4, a waterproof member 70 is adhered to the waterproof breathable lining 24 along the bottom end 22 of the lining unit 20 to close the opening 221. In this embodiment, the waterproof member 70 includes a waterproof plate.

Figure 5:
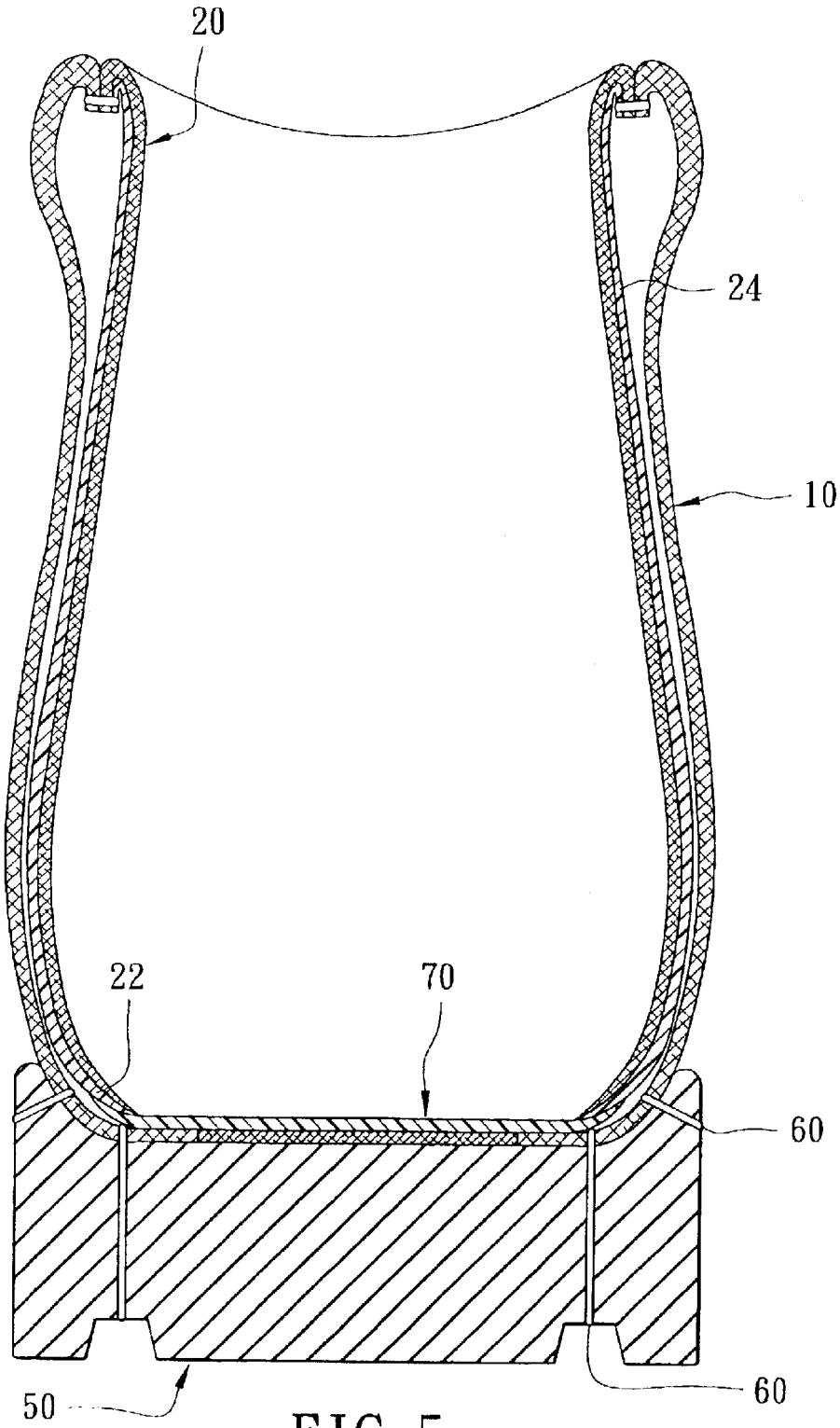
FIG. 5 is a sectional view of the first preferred embodiment, illustrating the step of re-inserting the bottom end of the lining unit together with the waterproof member into the upper.

Referring to FIG. 5, the lining unit 20, together with the waterproof member 70, is re-inserted into the upper 10, thereby accomplishing a waterproof shoe of the present invention.

In the preferred embodiment of the process according to this invention, the waterproof member 70 is secured to the waterproof breathable lining 24 to form a sock-like waterproof structure with satisfactory waterproofing characteristics. Moreover, the arrangement of the reinforcing sewing lines 60 strengthens the connection between the upper 10 and the outsole 50.

The waterproof shoe thus formed by using the process of this invention has the advantage that the bottom end 22 of the lining unit 20 can be pulled out of the upper 10 prior to sewing of the reinforcing sewing lines 60 so that the reinforcing sewing lines 60 do not extend through the waterproof breathable lining 24, thereby maintaining the waterproofing effect of the waterproof breathable lining 24. Therefore, when the waterproof member 70 is secured to the waterproof breathable lining 24, a closed sock-like waterproof structure can be obtained. In addition, the arrangement of the reinforcing sewing lines 60 can enhance the durability of the waterproof shoe.

Figure 6:
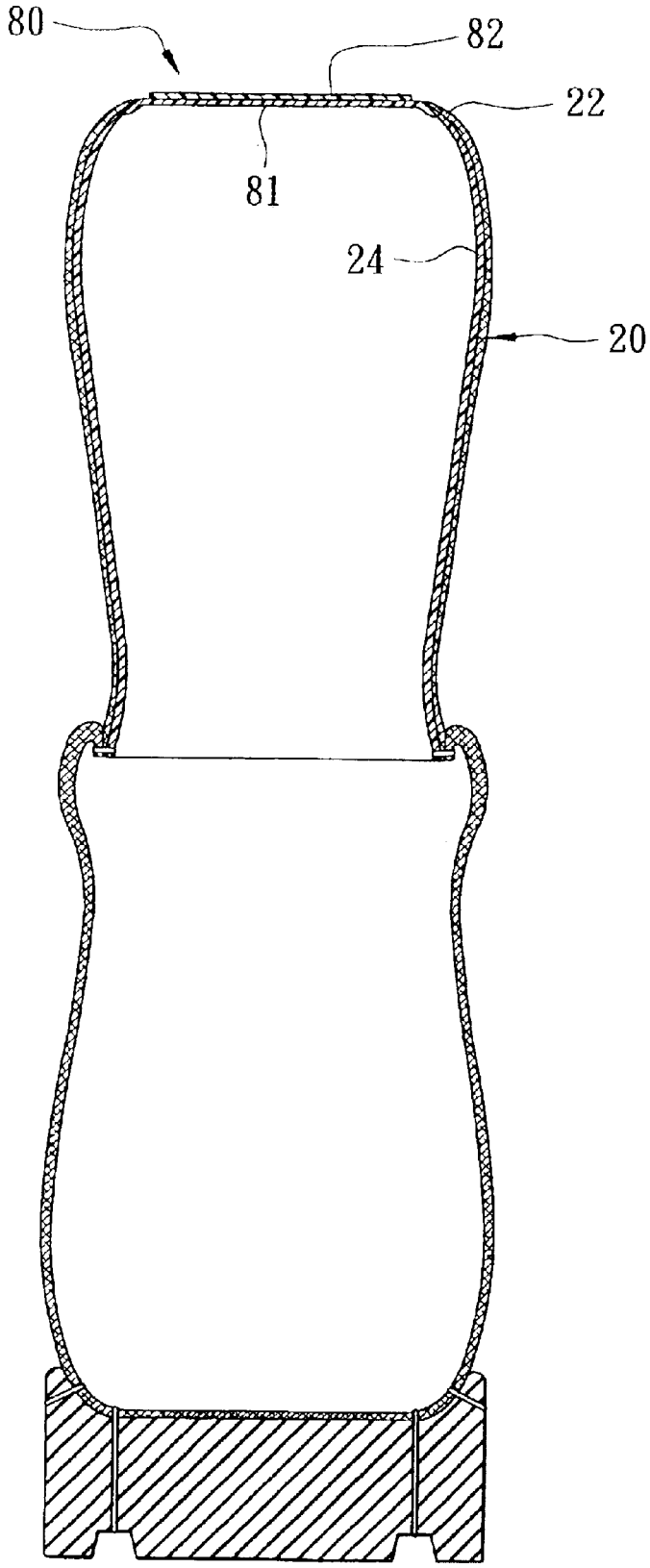
FIG. 6 is a sectional view similar to FIG. 4, which illustrates the second preferred embodiment of a process for making a waterproof shoe according to the present invention.

Referring to FIG. 6, the second preferred embodiment of a process for making a waterproof shoe according to the present invention differs from the first preferred embodiment in that the waterproof member 80 in the second embodiment further includes a sole pad 82 attached to the waterproof plate 81, which is adhered to the waterproof breathable lining 24 along the bottom end 22 of the lining unit 20, thereby achieving the same effects of the first preferred embodiment.

Figure 7:
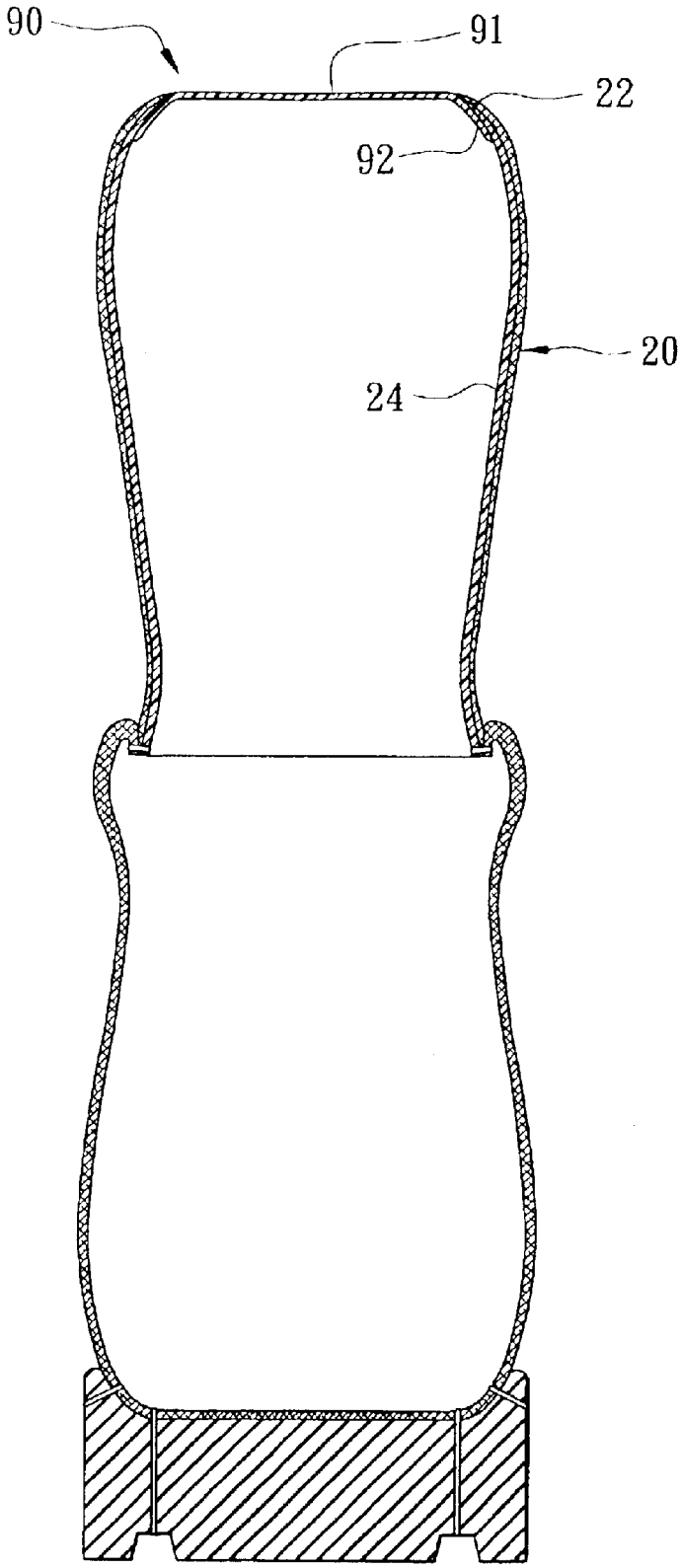
FIG. 7 is a sectional view similar to FIG. 4, which illustrates the third preferred embodiment of a process for making a waterproof shoe according to the present invention.
Figure 8:
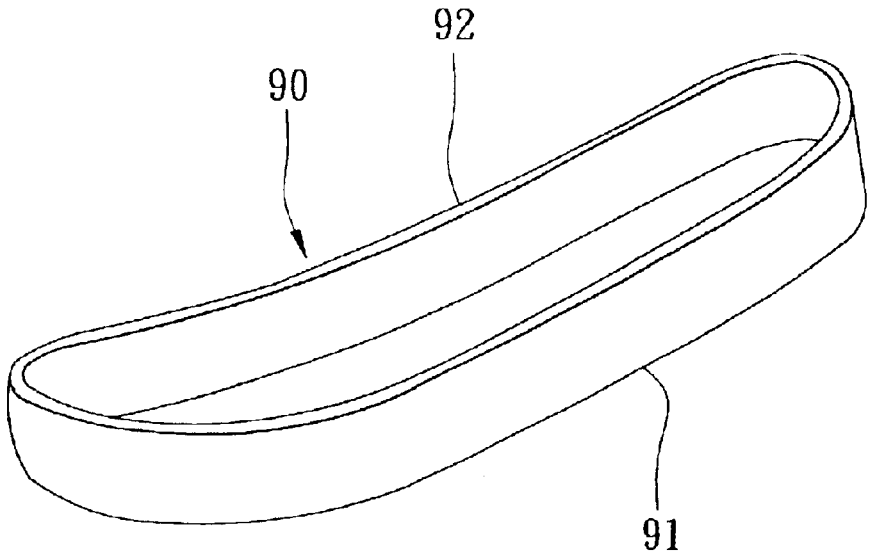
FIG. 8 is a perspective view of the waterproof member employed in the third preferred embodiment.
Figure 9:
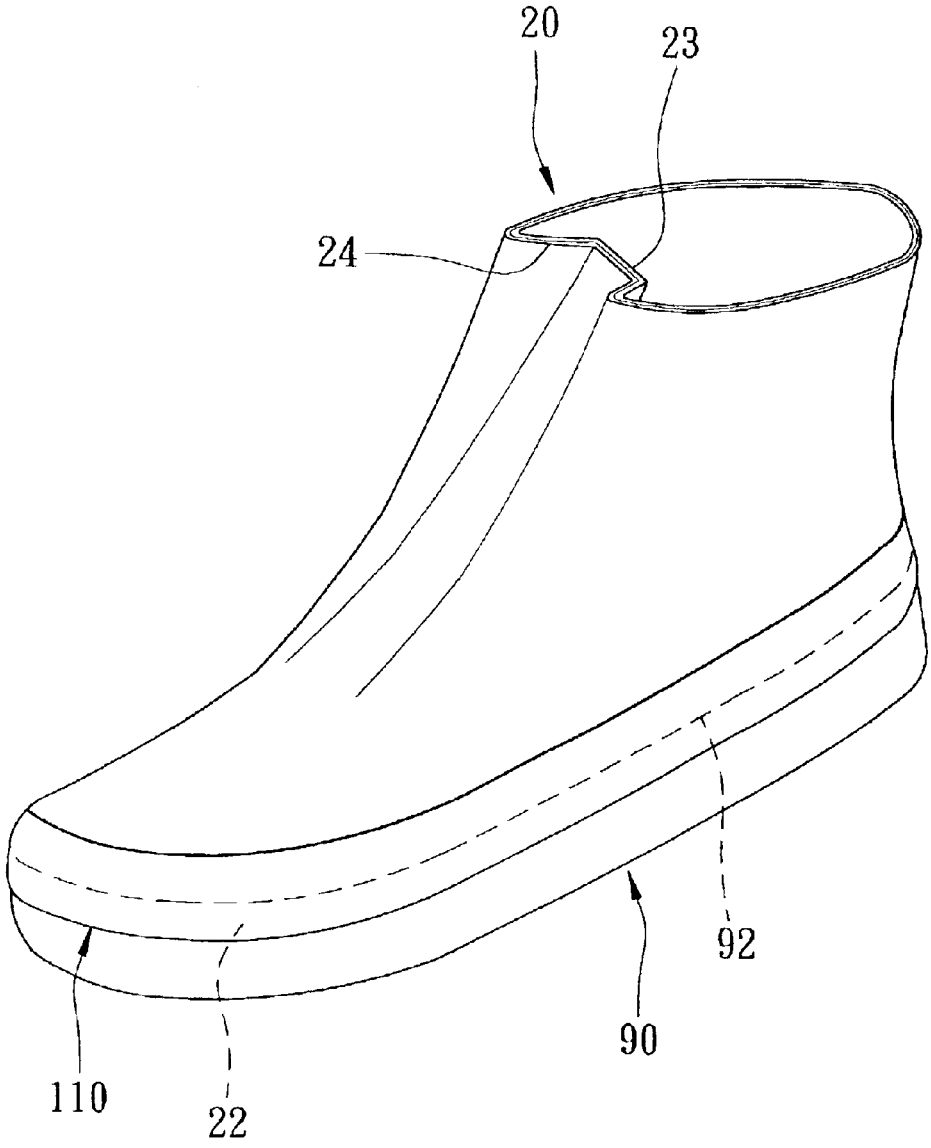
FIG. 9 is a perspective view of the fourth preferred embodiment of a process for making a waterproof shoe, illustrating the step of attaching a waterproof member to a bottom end of a lining unit.
Figure 10:
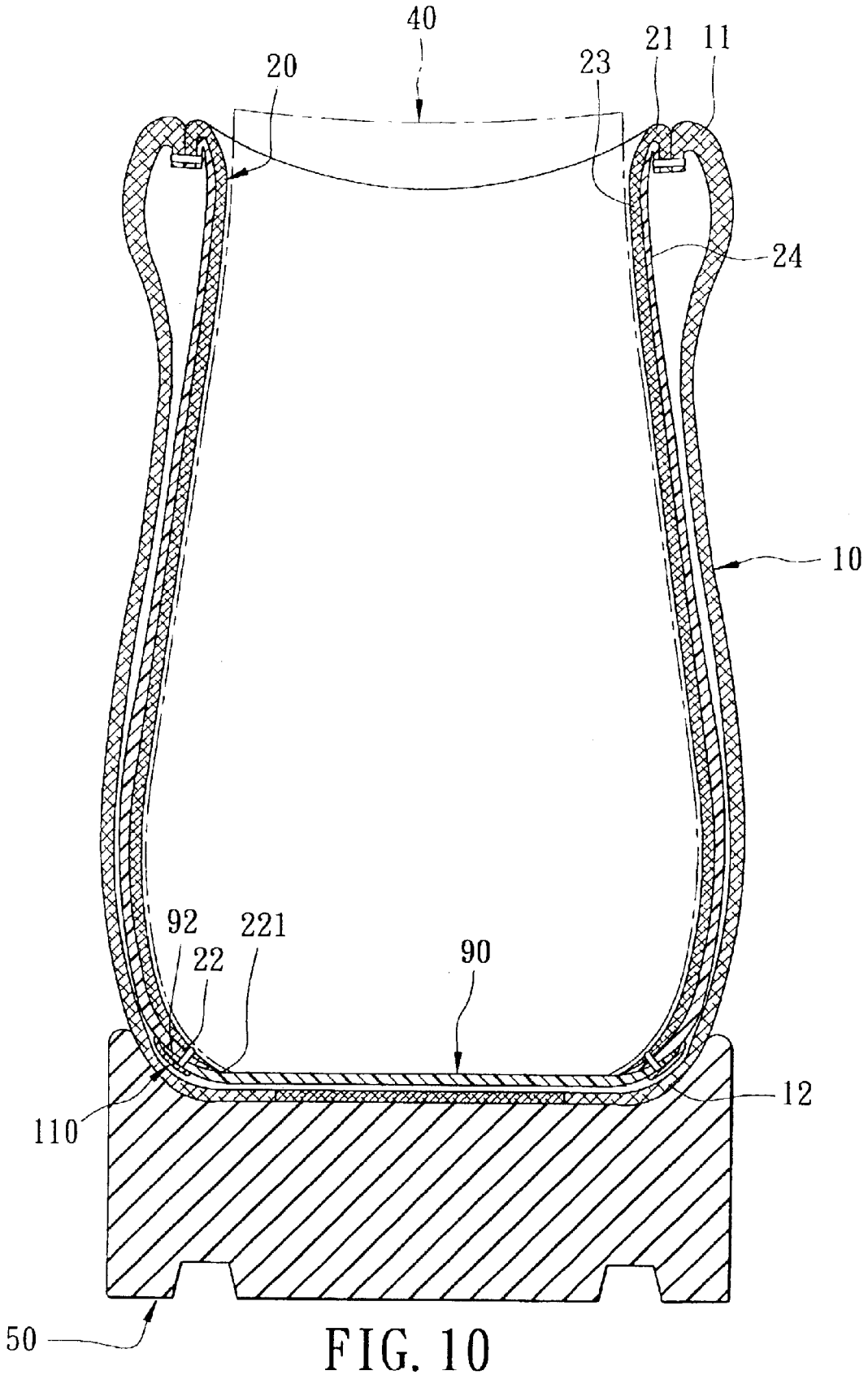
FIG. 10 is a sectional view of the fourth preferred embodiment, showing the waterproof shoe in a semi-finished state.

Referring to FIGS. 7 and 8, the third preferred embodiment of a process for making a waterproof shoe according to the present invention differs from the first preferred embodiment in that the waterproof member 90 is integrally formed as a cup member which has a sole region 91 and an upward flange 92 extending upward from a periphery of the sole region 91. The upward flange 92 is connected to the waterproof breathable lining 24 along the bottom end 22 of the lining unit 20, thereby achieving the same effects of the first preferred embodiment.

Figure 11:
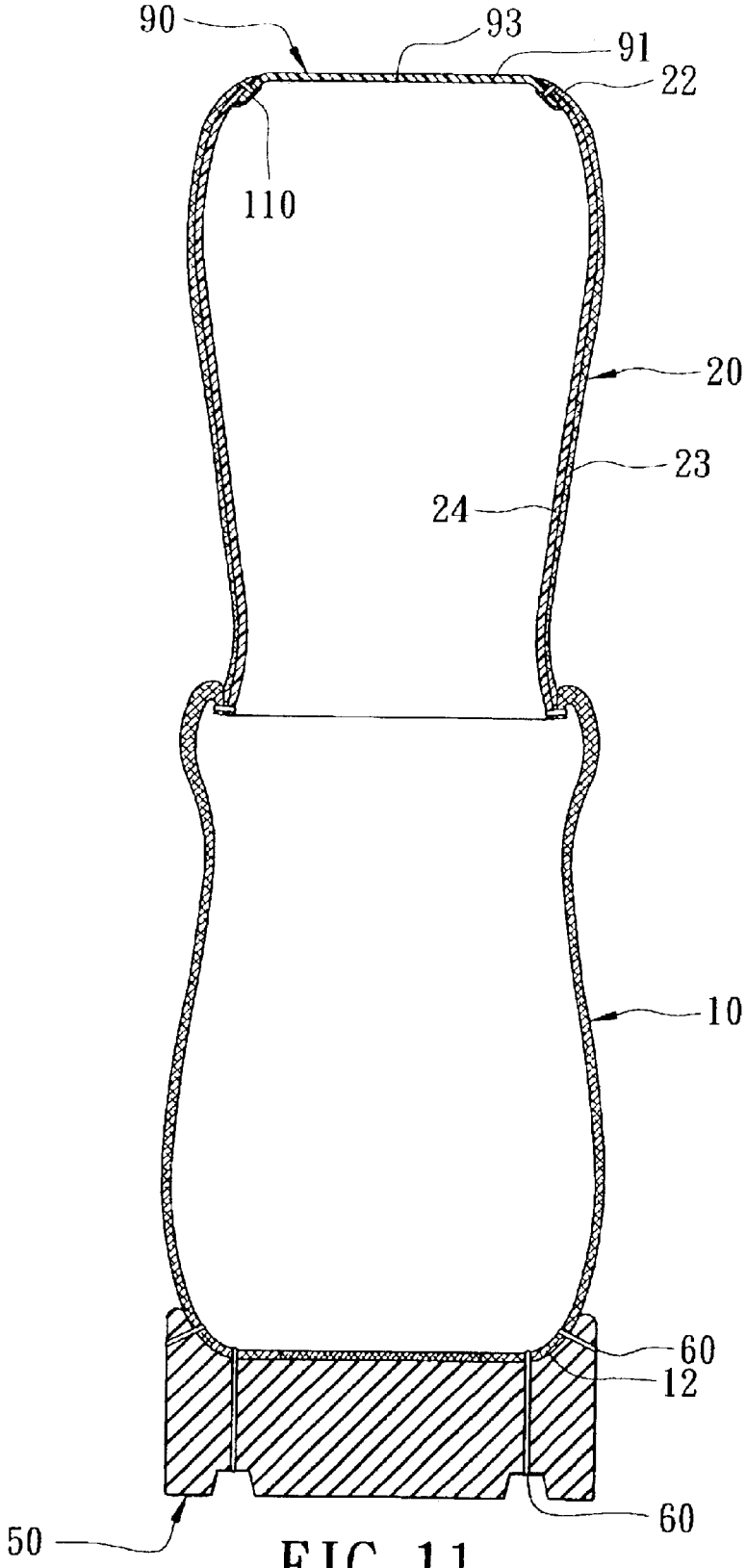
FIG. 11 is a sectional view of the fourth preferred embodiment, illustrating the step of pulling a bottom end of the lining unit and the waterproof member out of the upper and the step of making a cut in the waterproof member.
Figure 12:
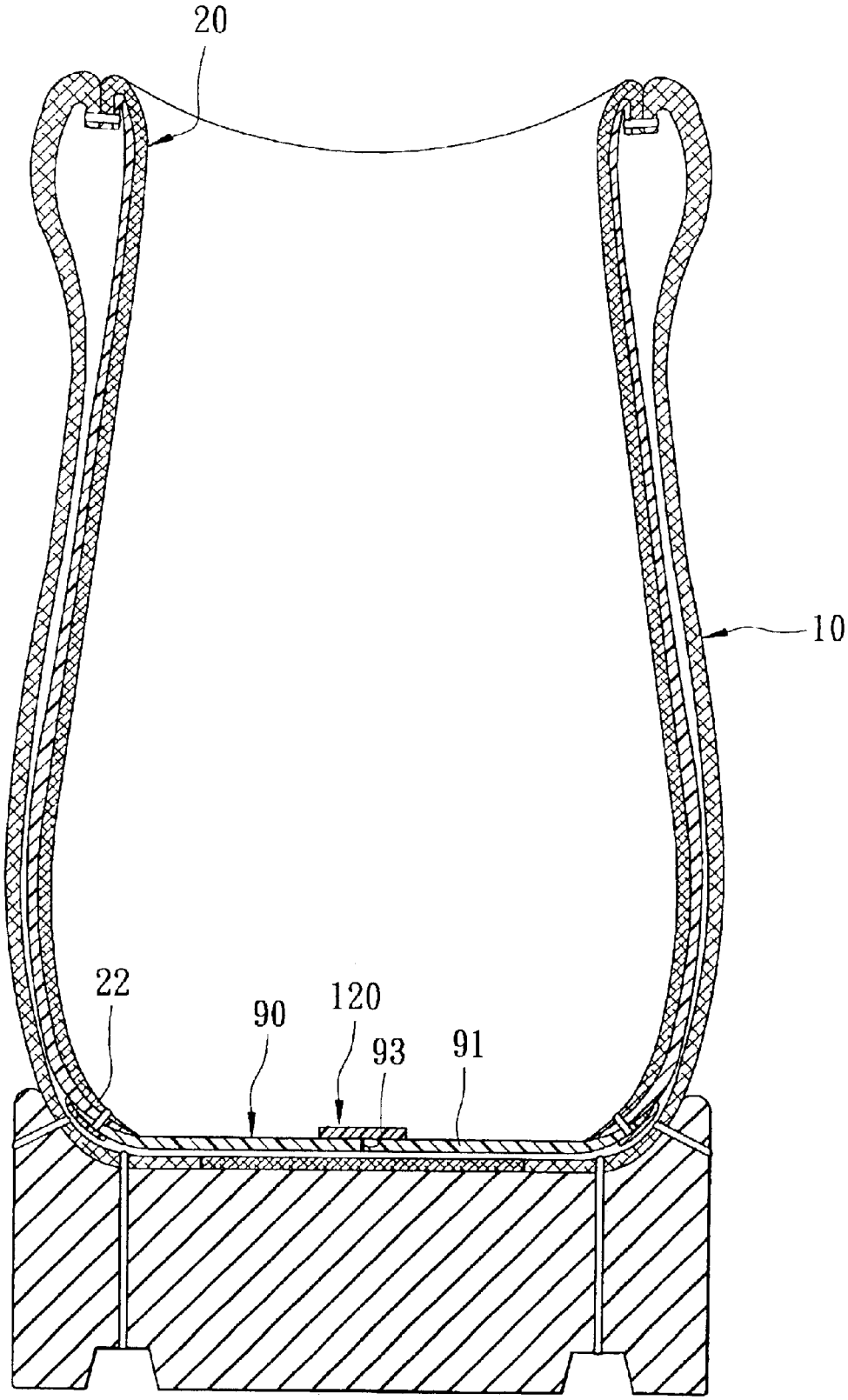
FIG. 12 is a sectional view of the fourth preferred embodiment, illustrating the step of sealing the cut in the waterproof member with a waterproof element and the step of re-inserting the bottom end of the lining unit and the waterproof member into the upper.

FIGS. 9 to 12 show the fourth preferred embodiment of a process for making a waterproof shoe according to the present invention. In this embodiment, the bottom end of the waterproof breathable lining 24 is first sewn to the top end of the upward flange 92 of the waterproof member 90. Next, the top end of the inner lining 23 is sewn to the top end of the waterproof breathable lining 24, and the bottom end of the inner lining 23 is attached to the upward flange 92. A waterproofing strip 110 is adhered to the waterproof member 90 along the sewing line. In this step, the waterproof breathable lining 24 and the waterproof member 90 cooperatively form a closed sock-like waterproof structure. Moreover, in this step, the sock-like waterproof structure can be subjected to a waterproof test so as to ensure product quality. Thereafter, the top end 11 of the upper 10 is sewn to the top end 21 of the lining unit 20, and the last 40 is inserted into the inner lining 23 through the top end 21 of the lining unit 20 to attach the outsole 50 to the bottom end 12 of the upper 10. Referring further to FIG. 11, the last 40 is then removed, and the lining unit 20, together with the waterproof member 90, is pulled out from the upper 10.

Thereafter, a cut 93 is provided in the waterproof member 90 so that the waterproof member 90 opens to permit passage of the component of the sewing machine (not shown) therethrough and into the upper 10 to form the reinforcing sewing lines 60 along the bottom end; 12 of the upper 10 such that the bottom end 12 of the upper 10 is connected to the outsole 50.

Subsequently, a waterproof element 120 (see FIG. 12) is attached to the waterproof member 90 along the cut 93 so as to seal the cut 93. Then, the bottom end 22 of the lining unit 20, together with the waterproof member 90, is re-inserted into the upper 10.

In summary, the process of the present invention ensures that the waterproof characteristic of the shoe will not be damaged during manufacture. Besides, the connection between the upper and the outsole can be enhanced.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A process for making a waterproof shoe, comprising:

(a) preparing an upper and a waterproof lining unit, each of which opens at top and bottom ends thereof;

(b) placing said lining unit within said upper, and connecting said top end of said upper to said top end of said lining unit;

(c) attaching a cover member to said bottom end of said upper to close said bottom end of said upper;

(d) inserting a last into said lining unit, and attaching an outsole to said bottom end of said upper;

(e) removing said last from said lining unit;

(f) pulling out said lining unit from said upper through said top end of said upper so that said bottom end of said lining unit moves away from said upper;

(g) sewing said outsole to said bottom end of said upper by using a sewing machine, thus forming a reinforcing sewing line that interconnects said outsole and said upper, wherein a component of said sewing machine is inserted into said upper through said bottom end of said lining unit;

(h) sealing said bottom end of said lining unit after step (g); and (i) re-inserting said lining unit into said upper.

2. The process as claimed in claim 1, wherein said bottom end of said lining unit defines a substantially sole-shaped opening, and said opening is closed by using a waterproof member in step (h).

3. The process as claimed in claim 2, wherein said lining unit is provided by assembling together an inner lining and a waterproof breathable lining, both of which define said sole-shaped opening.

4. The process as claimed in claim 3, wherein said waterproof member includes a waterproof plate which is secured to said waterproof breathable lining along said bottom end of said lining unit.

5. The process as claimed in claim 4, wherein said waterproof member further has a sole pad attached to said waterproof plate.

6. The process as claimed in claim 3, wherein said waterproof member is formed as a cup member which has a sole region and an upward flange extending upward from a periphery of said sole region, said upward flange being connected to said waterproof breathable lining along said bottom end of said lining unit.

7. The process as claimed in claim 3, wherein said inner lining and said waterproof breathable lining are interconnected at said top end of said lining unit.

8. The process as claimed in claim 3, wherein said waterproof breathable lining is adhered to an outer surface of said inner lining, said waterproof breathable lining being disposed between said upper and said inner lining.

9. The process as claimed in claim 2, wherein said lining unit includes an inner lining and a waterproof coating layer which is applied to an outer surface of said inner lining, said waterproof coating layer being disposed between said inner lining and said upper.

10. The process as claimed in claim 9, wherein said waterproof member is a waterproof plate which is attached to said waterproof coating layer along said bottom end of said lining unit.

11. The process as claimed in claim 10, wherein said waterproof member further has a sole pad attached to said waterproof plate.

12. The process as claimed in claim 9, wherein said waterproof member is formed as a cup member which has a sole region and an upward flange extending upward from a periphery of said sole region, said upward flange being connected to said waterproof coating layer along said bottom end of said lining unit.

13. The process as claimed in claim 1, wherein said bottom end of said lining unit defines a substantially sole-shaped opening, said opening is closed by attaching a waterproof member to said bottom end of said lining unit, and said waterproof member is provided with a cut before step (g) so that said waterproof member opens and permits passage of said component of said sewing machine used in step (g).

14. The process as claimed in claim 13, further comprising sealing said cut, in step (h), by attaching a waterproof element to said waterproof member along said cut.

* * * * *